United States Patent [19]

Dunlap

[11] 4,085,306

[45] Apr. 18, 1978

[54] KEYBOARD SWITCH ASSEMBLIES

[75] Inventor: Bill D. Dunlap, Longmont, Colo.

[73] Assignee: KB-Denver, Inc., Frederick, Colo.

[21] Appl. No.: 804,945

[22] Filed: Jun. 9, 1977

[51] Int. Cl.[2] ..... H01H 1/06; H01H 13/52

[52] U.S. Cl. ..... 200/275; 200/5 A; 200/159 B; 200/292

[58] Field of Search ..... 361/411; 200/1 R, 5 R, 200/5 A, 52 R, 159 B, 275, 302, 292; 29/622

[56] References Cited

U.S. PATENT DOCUMENTS

| | | | |
|---|---|---|---|
| 3,676,615 | 7/1972 | Wiedmer | 200/159 B X |
| 3,676,616 | 7/1972 | Wiedmer | 200/159 B X |
| 3,749,859 | 7/1973 | Webb et al. | 200/159 B X |
| 3,751,612 | 8/1973 | Hansen | 200/52 R |
| 3,796,843 | 3/1974 | Durkee et al. | 200/159 B X |
| 3,806,673 | 4/1974 | Boulanger | 200/159 B X |
| 3,908,109 | 9/1975 | Studebaker | 200/275 |
| 3,967,084 | 6/1976 | Pounds | 200/302 X |
| 4,018,999 | 4/1977 | Robinson et al. | 200/5 A |

FOREIGN PATENT DOCUMENTS

| | | | |
|---|---|---|---|
| 2,522,269 | 12/1975 | Germany | 200/5 A |

*Primary Examiner*—James R. Scott
*Attorney, Agent, or Firm*—Hugh H. Drake

[57] ABSTRACT

A keyboard assembly includes an insulative substrate upon which are carried a plurality of conductive paths. Respective portions of the paths are selectively bridged upon depression of a dome shaped conductive resilient contact element. Each contact element has a single foot disposed along a marginal portion thereof to allow the dome shaped element to be deformed downwardly upon depression at its apex. The foot of each contact element is in physical and electrical contact with selected ones of the conductive paths and the dome shaped element is adapted to simultaneously engage a plurality of such paths upon depression at the apex. An indentation is provided in the substrate immediately beneath the apex of each contact element to better assure simultaneous contact of the plurality of conductive paths immediately beneath the dome shaped contact element.

7 Claims, 8 Drawing Figures

KEYBOARD SWITCH ASSEMBLIES

BACKGROUND OF THE INVENTION

The present invention relates generally to keyboard assemblies and more particularly to a keyboard substrate that carries resilient domes each of which may be depressed to close a circuit.

Developments in solid state electronics have led to great reduction in the size of instruments such as calculators and related computational apparatus. In the kind of unit which employs a keyboard to permit input by means of finger tip push button depression, the keyboard assembly has tended to pose at least as much of a limitation upon size reduction of the overall unit as the electronic components which perform the interrelated operations. In furtherance of miniaturation of the keyboard assembly, one general approach implemented by several different manufacturers has involved the use of an electrical switch element in the form of a resilient metal dome. The marginal edge of the dome is in electrical contact with a first terminal carried by an insulating substrate, while the center of the dome overlies a second terminal also carried by the substrate. Upon depression of the central region of the dome into cntact with the second terminal, a connection is completed between the two terminals.

In its simplest form, such a dome is a smooth sector of a sphere. One drawback in the use of a simple sphere segment has been its lack of a sufficiently effective tactile feedback. That is, the user finds it difficult to detect through the sense of feel in this fingertips just when actual electrical contact has been made upon depression of the push button which flexes the domes. Thus, it becomes desirable that the dome exhibit what at least feels like a snap action. To this end, domes have been developed which include some sort of polygonal, usually triangular, shaping. In some cases, the marginal edge portion of the domes have been cut so as to define a polygonal shape. In another case, the marginal edge of the dome has been retained in circular shape but the body of the dome has been embossed in a pattern which has a generally triangular shape. In all these cases, the dome has been further embossed or deformed at each of the corners of the polygon so as to form a foot which rests upon a corresponding electrical terminal carried by the insulating substrate. A leading difficulty with these approaches has been a decided tendency for metallic fractures to develop at the edges of the feet leading to failure of performance of the dome prior to failure of any other component of the associated instrument.

Several procedures have been employed on substrates so that they carry the necessary conductive leads which are plated or otherwise printed thereon. In any event, however, in keyboard systems utilizing the resilient dome contact element, the foot or marginal peripheral area of the dome is in engagement with one conductive path and the apex or central area of the contact element is adapted to selectively engage, upon depression, a contact element disposed immediately beneath the apex of the contact element. The apex of a contact element upon depression will normally make a point type contact with the underlying conductive path, so with conventional dome shaped contact elements it is difficult to simultaneously engage a plurality of conductive paths with a single contact element. In numerous applications, the ability to simultaneously engage a plurality of conductive paths with a single dome shaped element is desirable and it is to this end that the present invention has been developed.

Accordingly, it is a primary object of the present invention to provide a new and improved contact element for keyboard switch assemblies which is adapted to simultaneously engage a plurality of conductive paths disposed immediately therebeneath.

It is another object of the present invention to provide a new and improved dome shaped contact element for a keyboard switch assembly wherein the contact element upon depression engages a relatively broad area of the substrate therebeneath as compared with conventional dome shaped contact elements which typically make only point contact with the underlying element.

SUMMARY OF THE INVENTION

A keyboard assembly constructed in accordance with the present invention includes an insulative substrate upon which are carried a plurality of conductive paths, respective portions of which are selectively bridged upon depression of conductive resilient contact elements. Each contact element is in the shape of a dome having a peripheral portion thereof with a single foot formed to extend downwardly away from the apex of the element and with the foot adapted to support the element for selective engagement with underlying conductive paths. The dome shaped elements are disposed adjacent to the substrate with the foot being in electrical and physical contact with a portion of one of the conductive paths. The central region of each dome shaped element is in registry over selected portions of a plurality of conductive paths so as to enable connection between the path engaged by the foot and the other parts selectively engaged by the central region of the dome shaped element.

It has been found that by supporting the dome shaped contact element with a single foot, the element when depressed will contact a relatively broad area beneath the dome so that a plurality of conductive paths can be simultaneously engaged with the dome so as to complete a plurality of circuits through the contact element. This is contrary to conventional contact elements which are supported by more than one foot and which are known to make only point contact with an underlying conductive path upon depression.

In one embodiment of the present invention, the substrate underlying each contact element has a depression recessed area which is smaller in cross-section that the contact element itself and has the plurality of conductive paths which are to be engaged by the contact element disposed in an array around the recessed area. In this manner, the contact element will reliably contact the broad area in which a plurality of conductive paths can be disposed and will not make a point contact with only a small pinpointed location therebeneath.

The features of the present invention which are believed to be novel are set forth with particularity in the appended claims. The organization and manner of operation of the invention together with further objects and advantages thereof may be understood by reference to the following description taken in connection with the accompanying drawings.

DESCRIPTION OF THE PREFERRED EMBODIMENT

Figure 1:
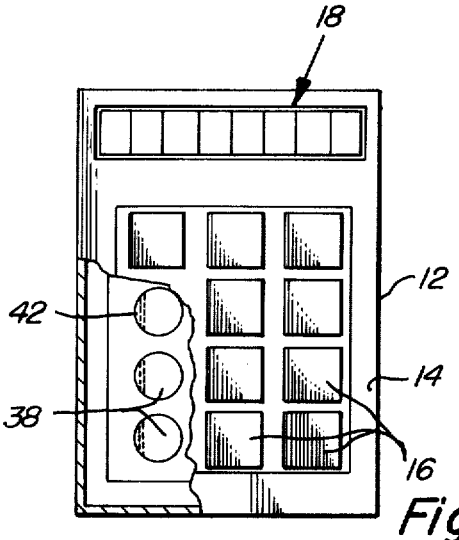
FIG. 1 is a plan view with parts broken away illustrating a calculator device incorporating the present invention.

An electronic calculator 10 as shown in FIG. 1, includes a housing 12 which encloses integrated computational circuitry and devices (not shown) and a keyboard assembly. An apertured cover plate 14 positions and captivates a plurality of push buttons 16 that individually are marked to indicate respective different functions of parameters. An indicator lamp bank 18 provides visual readout of the results calculated.

For supporting the different electrical elements associated with the keyboard assembly, a substrate 20 is provided of generally rectangular configuration. The substrate is formed of a laminate of insulating material. While many of the details of the substrate are not felt to be pertinent to the present invention, a description thereof may be found in U.S. Pat. No. 3,967,084, owned by the assignee of the present invention. The disclosure in the above-referenced patent relating to the details of the substrate is hereby incorporated by reference.

Figure 6:
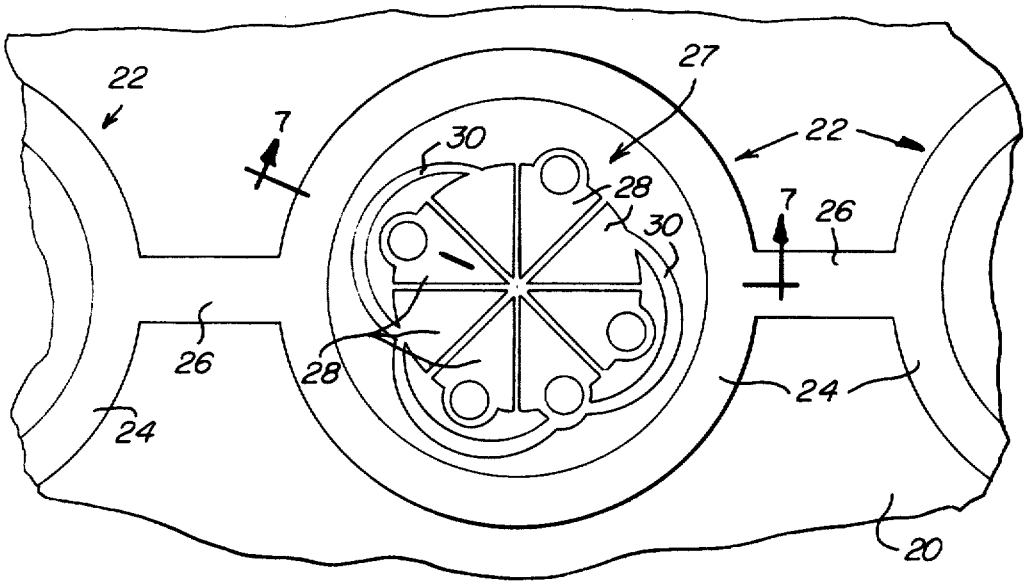
FIG. 6 is a top plan view of a switch location on the substrate of the calculator device shown in FIG. 1.
Figure 8:
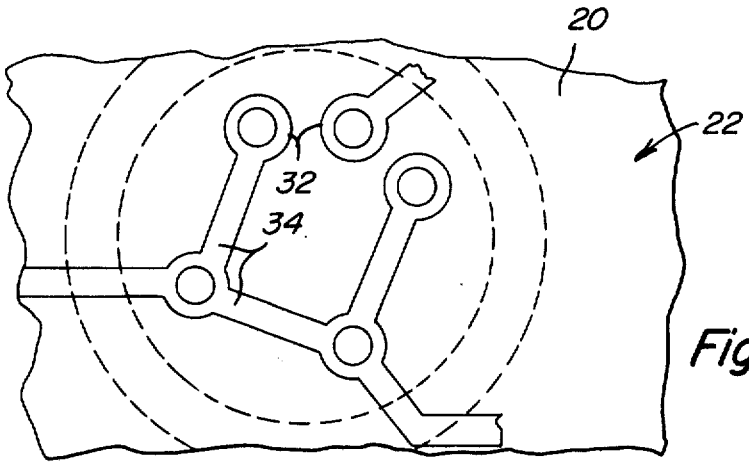
FIG. 8 is a fragmentary bottom plan view of the switch location shown in FIG. 6.

The substrate 20 carries thereon a plurality of electrically conductive leads which terminate at different switch sites 22 with each site having a plurality of terminals or lands. One such switch site is illustrated in FIG. 6 to have an outer circular terminal 24 connected by leads 26 to adjacent outer circular terminals corresponding to adjacent switch sites 22. Within each circular outer terminal is a circular array 27 of generally pie-shaped terminals 28, in the disclosed embodiment there being eight of such terminals, with the pie-shaped terminals being separated from each other so as not to be in electrical contact with adjacent pie-shaped terminals. Selected ones of the pie-shaped terminals are connected to other of the pie-shaped terminals by arcuate connecting leads 30. Certain of the pie-shaped terminals also include conductive sleeves 32 which extend through the substrate 20 and are connected to leads 34 on the undersurface of the substrate which are interconnected in accordance with particular functions to be performed by the calculator device. The underside of the substrate illustrating the connection of the conductive sleeves 32 to the various conductive leads 34 is illustrated in FIG. 8.

Figure 7:
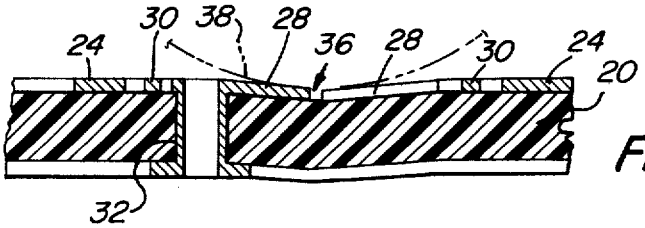
FIG. 7 is a section taken along line 7—7 of FIG. 6.

As best seen in FIG. 7, at the geometric center of the circular array of pie-shaped terminals 28, the substrate 20 defines an indentation 36, depression, recess, hollow configuration or like means so that the center of the array 27 is effectively lower or more open than the outer perimeter of the array. The indentation is preferably smooth and arcuate in configuration to receive the dome area of a depressed contact element. The purpose for the indentation 36 will become more clear later with a description of the contact element adapted to cooperate with the array of pie-shaped terminals in performing various electronic functions.

Covering each switch site is a dome-shaped resilient contact element 38. Each contact element has a central dome area 40 in the form of a portion of a sphere and has a single foot 42 formed along a marginal portion of the central dome area which extends downwardly away from the apex 44 of the central dome area. When the contact element is assembled in the calculator device 10, each contact element is disposed adjacent to the substrate 20 so that the foot 42 is in physical and electrical contact with an outer circular terminal 24 to enable connection between the array of pie-shaped terminals 28 and the outer circular terminal 24 upon depression of the contact element.

The contact elements 38 may be formed in accordance with a procedure defined in the above-noted U.S. Pat. No. 3,967,084, and the procedure set forth therein is hereby incorporated by reference. Since that procedure is not felt to be significant to an understanding of the present invention, it will not be described herein.

As will be readily appreciated, since there is only one foot 42 on each contact element 38 and since the outer terminal 24 on which the foot 42 rests extends entirely around each switch site 22, the contact elements can be oriented in any direction simplifying the process of assembling a calculator utilizing contact elements of the type herein described.

Figure 3:
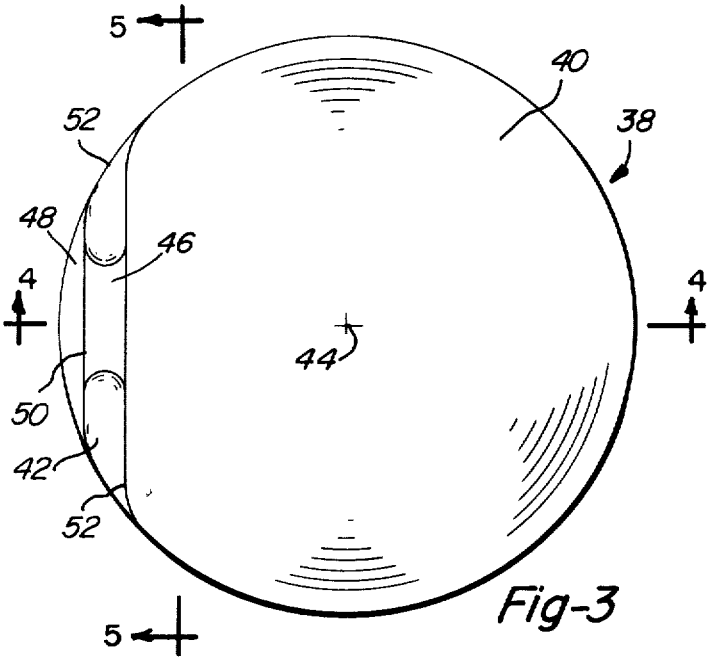
FIG. 3 is a bottom plan view of a contact element utilized in the calculator device shown in FIG. 1.
Figure 5:
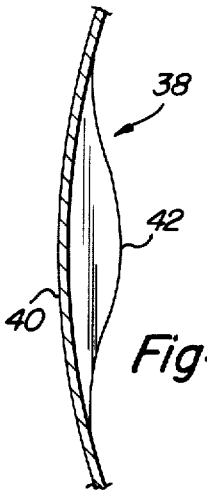
FIG. 5 is a section taken along line 5—5 of FIG. 3.
Figure 4:
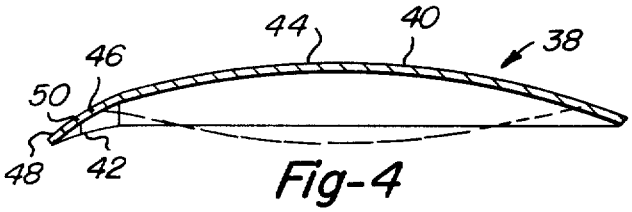
FIG. 4 is a section taken along line 4—4 of FIG. 3.

The formation of the foot 42 on the contact element 38 is particularly significant if long lifetimes are to be obtained. The contact element of the present invention is preferably formed out of stainless steel with the steel having a grain and with the foot of the contact element being disposed at one terminal end of the grain. That is, the foot 42 would be positioned at the end of a line passing parallel to or along the grain of the contact element. The foot is formed so as to include a first panel 46 that slants downwardly from the adjacent surface of the dome shaped area 40. A second panel 48 slants outwardly downward beyond the first panel 46. The junction 50 between panels 46 and 48 is smeared out at its opposite end portions so as to merge smoothly into the peripheral margin of the central dome area 40 as shown in FIG. 3. Similarly, the opposite end portions defining junction 52 between panel 46 and dome area 40 are smeared out so as to also merge smoothly into the peripheral margin of the dome area. The smearing of the end portions of both junctions is such as to eliminate the exterior or upper creases that had defined those end portions. In the alternative, there may be only one such panel. However, the junctions 52 with the spherical surface must have the upper creases smeared out as described in order to insure long lifetimes.

The contact element 38 of the type described, wherein the dome-shaped central portion 40 is supported by a single foot 42, has been found to establish a relatively broad contact area upon depression of the central dome-shaped area. Since the contact area is relatively broad, it has been found that simultaneous contact with a plurality of contact terminals 28 arranged in a circular array, as shown in FIG. 6, can be accomplished. Such simultaneous contact has not been achievable with prior art contact elements utilizing a plurality of supporting feet as these contact elements are known to establish only point contact thereby not being capable of simultaneously engaging or contacting a plurality of underlying terminals.

The relatively broad contact area of the contact element 38 is illustrated in FIG. 7 and, as will be appreciated, the element contacts a relatively broad area of the circular array of pie-shaped terminals 28 with the lowermost area of contact coinciding with the center of the indented area 36 provided at the geometric center of the circular array 27 of pie-shaped terminals. Preferably, the indented area 36 conforms in configuration to the inverted configuration of the dome so as to optimize the contact area of the dome on the pie-shaped terminals.

Of course, simultaneous contact with a plurality of terminals by a single contact element provides greater versatility for each switch enabling more varied functions for a calculator device or the like utilizing the concepts of the present invention.

As mentioned previously, the contact elements 38 are mounted on the substrate 20 in registry or in overlying relationship with each switch site 22. A thin layer of flexible insulating material 54 is coated on its underside with a film of an adhesive material and is laid over the substrate 20 and contact elements 38 to hold the contact elements in position at a switching site. Included in the layer of material 54 are a plurality of apertures 56 which are distributed in an array which corresponds with the array of the different switch sites on the substrate. Thus, each aperture 56 is aligned to be in registry with the respective different ones of the contact elements 38. However, each of apertures 56 has a diameter which is smaller than the width of the associated contact element. In use, the layer of material 54 is adhesively affixed both to the separate contact elements and to the upper surface of the substrate 20 itself. This serves to maintain physical and electrical contact between the feet 42 and the different outer terminals 24 on the substrate. On the other hand, the apertures permit direct contact of the associated push buttons 16 with the region of each central dome area 40 surrounding the apex 44 of the dome area. This serves to retain a high degree of tactile feedback which would be lost if the coating layer of matrial 54 were permitted to extend continuously across the apices of the various contact elements.

Figure 2:
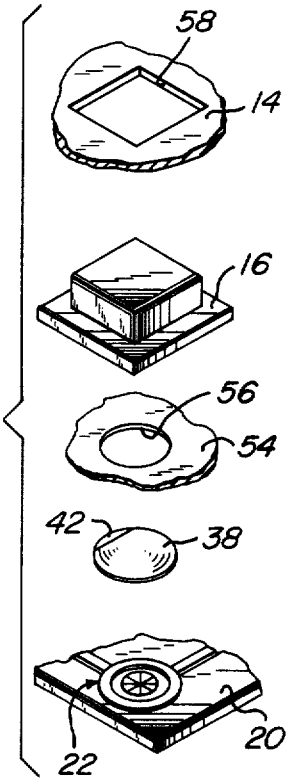
FIG. 2 is a exploded fragmentary view illustrating the relationship of various component parts of the calculator device shown in FIG. 1.

FIG. 2 best illustrates the relationship of each contact element 38 to the switch site 22 on the underlying substrate 20, the coating layer of material 54, the switch button 16 and the cover plate 14 which holds the push buttons in position. As seen in FIG. 2, the cover plate 14 has openings 58 therein which mate with the respective push buttons with the push buttons in turn being in registry over the apertures 56 in the cover layer of material 54 and the contact elements 38 disposed therein. As mentioned previously, the contact elements are positioned at a switching site on the substrate whereby depression of a push button will cause the dome shaped area to be inverted downwardly making a broad flat simultaneous contact with each of the pie-shaped terminals 28 disposed at the switching site.

While particular embodiments have been shown and described, it will be obvious to those skilled in the art that changes and modifications may be made without departing from the invention in its broadest aspects, and, therefore, the aim in the appended claims is to cover all such changes and modifications as fall within the true spirit and scope of the invention.

It is claimed that:

1. In a keyboard assembly which includes an insulative substrate upon which is carried a plurality of conductive paths, respective portions of which are selectively bridged upon depression of a conductive resilient contact element, the improvement comprising:

said contact element being in the shape of a dome and having a marginal portion formed downwardly away from its apex to constitute a single foot with said foot occupying only a limited minor extent of the margin of said element, and said dome-shaped element being disposed adjacent to said substrate with said foot being in electrical and physical contact with one of said portions of one of said paths, a central area of said dome-shaped element being in registry over at least one other of said portions in at least one other of said paths to enable connection between said central area and at least one other portion of said paths upon depression of said central area.

2. In the keyboard assembly of claim 1, wherein said central area is in registry over a plurality of said other paths and is adapted upon depression to make substantially simultaneous physical and electrical contact with each of said plurality of other portions.

3. In the keyboard assembly of claim 2, wherein said plurality of other portions of said other paths are of generally pie-shaped configuration and disposed in a noncontacting side-by-side circular array beneath said dome shaped element.

4. In the keyboard assembly of claim 3, said substrate defining means at the geometric center of said circular array effective to at least partially receive, below the level of the margin of said element, a portion of said dome-shaped element when the element is depressed in physical and electrical contact with said pie-shaped other portions of said other paths.

5. In the keyboard assembly of claim 3, said substrate having a recess in the upper surface thereof at the geometric center of said circular array, said recess being adapted to at least partially receive only a control portion of said dome-shaped element when the element is depressed in physical and electrical contact with said pie-shaped other portions of said other paths.

6. In the keyboard assembly of claim 1 wherein there are a plurality of such dome-shaped contact elements which are distributed in an array to overlie said substrate, each of said elements having such a foot in physical and electrical contact with respective conductive path portions disposed on said substrate with each of said portions defining a circle.

7. In the keyboard assembly of claim 3 wherein selected ones of said other pie-shaped portions are electrically interconnected such that contact with one of said interconnected pie-shaped portions by said dome-shaped contact element will effect an electrical contact with the other of said interconnected portions.

* * * * *